US005529025A

United States Patent [19]

Ranzinger et al.

[11] Patent Number: 5,529,025

[45] Date of Patent: Jun. 25, 1996

[54] COOLING SYSTEM FOR AN INTERNAL-COMBUSTION ENGINE OF A MOTOR VEHICLE COMPRISING A THERMOSTATIC VALVE WHICH CONTAINS AN ELECTRICALLY HEATABLE EXPANSION ELEMENT

[75] Inventors: Günter Ranzinger, Garching; Gerhart Huemer, Neukeferloh; Norbert Dembinski, München; Josef Krowiorz, Reichertshausen; Jochem Huber, München, all of Germany

[73] Assignee: Bayerische Motoren Werke AG, Munich, Germany

[21] Appl. No.: 277,004

[22] Filed: Jul. 19, 1994

[30] Foreign Application Priority Data

Jul. 19, 1993 [DE] Germany ..... 43 24 178.6

[51] Int. Cl.[6] ..... F01P 7/14

[52] U.S. Cl. ..... 123/41.1

[58] Field of Search ..... 123/41.1; 236/34, 236/34.5

[56] References Cited

U.S. PATENT DOCUMENTS

| | | | |
|---|---|---|---|
| 4,616,599 | 10/1986 | Taguchi et al. | 123/41.1 |
| 4,726,325 | 2/1988 | Itakura | 123/41.1 |
| 4,744,335 | 5/1988 | Miller | 123/41.1 |
| 4,964,371 | 10/1990 | Maeda et al. | 123/41.1 |
| 5,036,803 | 8/1991 | Nolting et al. | 123/41.1 |
| 5,195,467 | 3/1993 | Kurz | 123/41.1 |

FOREIGN PATENT DOCUMENTS

| | | |
|---|---|---|
| 3018682 | 11/1980 | Germany . |
| 3705232 | 9/1988 | Germany . |

*Primary Examiner*—Noah P. Kamen

*Attorney, Agent, or Firm*—Evenson McKeown Edwards & Lenahan

[57] ABSTRACT

A cooling system for an internal-combustion engine of a motor vehicle having a radiator and a thermostatic valve by which the temperature of the coolant can be controlled in a warm-up operation, a mixed operation and a radiator operation. The thermostatic valve contains an expansion element which can be electrically heated for reducing the coolant temperature, the expansion element being designed such that the coolant temperature is set without heating the expansion element in the warm-up operation and/or in the mixed operation to an upper working limit temperature. A control unit is provided which, as a function of sensed operating and/or environmental quantities of the internal-combustion engine, activates the heating of the expansion element, as required, in order to shift the operating mode of the cooling system from the warm-up operation or from the mixed operation of the upper working limit temperature in the direction of the mixed operation or radiator operation of a coolant temperature which is lower with respect to the upper working limit temperature.

10 Claims, 3 Drawing Sheets

COOLING SYSTEM FOR AN INTERNAL-COMBUSTION ENGINE OF A MOTOR VEHICLE COMPRISING A THERMOSTATIC VALVE WHICH CONTAINS AN ELECTRICALLY HEATABLE EXPANSION ELEMENT

BACKGROUND AND SUMMARY OF THE INVENTION

This invention relates to a cooling system for an internal-combustion engine of a motor vehicle comprising a radiator and a thermostatic valve by which the temperature of the coolant can be controlled in a warm-up operation, a mixed operation and a radiator operation, the thermostatic valve containing an expansion element which can be electrically heated for reducing the coolant temperature.

In cooling systems of this type, the thermostatic valve controls the flow of the coolant between the internal-combustion engine and the radiator in the following manner. During the warm-up operation, the coolant coming from the internal-combustion engine, essentially bypasses the radiator, flowing through a short-circuit back to the internal-combustion engine. During the mixed operation, the coolant coming from the internal-combustion engine flows partially through the radiator and partially through the short circuit back to the internal-combustion engine. During the radiator operation, the coolant coming from the internal-combustion engine flows essentially through the radiator back to the internal-combustion engine. The expansion element is electrically heated to enlarge the opening cross-section toward the radiator in comparison to an opening cross-section caused by the temperature of the coolant.

A cooling system of this general type is known, for example, from German Patent Document DE 30 18 682 A1. In this cooling system, an electric heating resistor is arranged in an expansion element of a thermostatic valve. Electric energy is supplied to this electric heating resistor through a stationarily held working piston. The electric energy is supplied via a control device in order to keep the coolant temperature set by the thermostatic valve constant better than a normal thermostatic valve. Therefore, the actual coolant temperature is measured and is compared with a given upper and with a given lower temperature value. When the upper temperature value is reached, electric energy is supplied to the heating resistor so that the thermostatic valve opens up more in order to achieve an increased cooling output and therefore a lower actual coolant temperature. When the actual coolant temperature falls below the lower temperature value, the supply of electric energy to the heating resistor is interrupted so that the expansion element is cooled by the colder coolant. As a result, the valve cross-section is reduced so that the actual coolant temperature will rise. These control cycles are repeated constantly in order to keep the coolant temperature of, for example, 95° C. as constant as possible.

From German Patent Document DE 37 05 232 A1, a temperature control device is known in which, instead of a conventional thermostatic valve comprising an expansion element, has a valve which can be controlled by a servomotor. In this temperature control device, the servomotor is controlled to adjust the valve as a function of a sensor which measures the coolant temperature in a pipe connected with the internal-combustion engine. In addition, the sensor has a heating device. The heating device can be switched on and off as a function of characteristic diagram quantities of the internal-combustion engine. Therefore, in the case of this temperature control device, by heating the sensor, a coolant temperature can be simulated which is higher than the real coolant temperature in order to increase the cooling of the coolant. The construction of this temperature control device requires particularly high expenditures and is therefore cost-intensive.

An object of the invention is to provide a cooling system of the initially described type that is as simple as possible so that, as a result, the operation of the internal-combustion engine can be optimized with respect to the fuel consumption and the exhaust gas values without any reduction of the power of the internal-combustion engine in the event of an increased power demand.

This and other objects are achieved by the present invention which provides an expansion element designed such that the coolant temperature is set in the mixed operation without heating the expansion element to an upper working limit temperature, and having a control unit which, as a function of sensed operating and/or environmental quantities of the internal-combustion engine, heats the expansion element, as required, in order to displace the operating mode of the cooling system in the direction of the radiator operation.

The upper working limit temperature is preferably identical to the consumption-optimal operating temperature of the internal-combustion engine and is slightly lower than the maximally permissible operating temperature of the internal-combustion engine. In certain preferred embodiments, the upper working limit temperature is above 100° C., particularly at approximately 105° C. The maximally permissible temperature is the highest possible temperature at which the internal-combustion engine can be operated in normal operation for an extended period of time without any disturbances. As a result, even when the electric heating of the expansion element fails, damage to the internal-combustion engine is prevented. Normally, the maximally permissible operating temperature is between 105° C. and 120° C.

If the expansion element is not electrically heated, an opening cross-section in the direction of the radiator occurs exclusively as a function of the coolant temperature. This opening cross-section causes a setting of the coolant temperature to the defined upper working limit temperature. By selecting a corresponding temperature-dependent material and a suitable constructive development, the expansion element is designed such that, in the case of the defined upper working limit temperature, the opening cross-section of the radiator is not yet maximal; that is, no pure radiator operation is achieved. Thus, by heating the expansion element, a further enlargement of the opening cross-section and thus a displacement in the direction of the radiator operation is possible.

In addition, the opening cross-section in the direction of the radiator and the opening cross-section in the direction of the short circuit bypassing the radiator are changed in opposite directions.

Therefore, an operating temperature of the internal-combustion engine that is as high as possible is reached in the normal operation; that is, when no increased power demand is made, such as in the full-load operation or when driving uphill. In this case, because of lower friction, the power consumption of the internal-combustion engine is less, so the fuel consumption can be lowered and the exhaust gas composition can be improved. However, in the event that the operating condition of the internal-combustion engine requires a lower coolant temperature level due to an increased power demand, the coolant temperature level may be quickly reduced. Electric energy is supplied to the heatable expansion element as a function of operating and/or environmental quantities, which further opens the thermostatic valve and as a result reduces the coolant temperature in a rapid manner. Excessive coolant or engine temperatures in the event of an increased power demand would result in a reduced volumetric efficiency and therefore in a reduced power.

In certain advantageous embodiments of the invention the control blocks the supply of electric energy to the expansion element when the sensed actual temperature of the coolant is below a predetermined desired temperature. In this case, the predetermined desired temperature is always under the defined upper working limit temperature. Thus, a control of the coolant temperature in the direction of a reduced temperature level will be carried out only when a minimum temperature has already been reached.

In certain embodiments of the invention, the control prevents the heating of the expansion element as a function of the vehicle speed. The idling can be determined when the motor vehicle is stopped, whereupon a cooling may be required because of the lack of an air stream and thus the expansion element is heated.

When a very high vehicle speed and, for example, also in addition a very large throttle valve opening angle is sensed, the conclusion is drawn that there is an increased power demand on the internal-combustion engine, whereby an increased cooling also becomes useful and thus the expansion element is heated.

In certain embodiments of the invention the control prevents the heating of the expansion element as a function of the rotational speed of the internal-combustion engine, of the throttle valve opening angle and/or the load condition of the internal-combustion engine.

For example, the control unit may compare the actual load condition and/or the actual throttle valve opening angle and/or the actual rotational speed with a predetermined threshold value and heat the expansion element when this threshold value is exceeded.

The load condition of the internal-combustion engine is determined, for example, by the rotational speed of the internal-combustion engine in conjunction with the opening angle of the throttle valve without any height correction or in connection with the air mass in the intake section with a height correction.

However, in the form of a characteristic diagram, a desired temperature of the coolant is also determinable as a function of the throttle valve angle and of the rotational speed, according to certain embodiments of the invention.

Therefore, for a high load or a high rotational speed or a large throttle valve opening angle, the required power output of the internal-combustion engine is not reduced by an excessively high operating temperature which could lead to impaired volumetric efficiency and thus to reduced power.

In certain embodiments of the invention, the control heats the expansion element when the actual temperature of the intake air or of the ambient air is above a predetermined value. Thus, in the case of high outside temperatures, for example, during slow driving, during idling when the vehicle is stopped or in a stop-and-go operation, overheating of the internal-combustion engine is prevented.

In certain embodiments of the invention the desired temperature of the coolant is taken from one or several tables, characteristic curves and/or characteristic diagrams as a function of several operating and environmental quantities. For example, for establishing a characteristic coolant temperature diagram, individual desired coolant temperatures are assigned to a plurality of operating points which are defined, for example, by values of the rotational speed of the internal-combustion engine, of the throttle valve opening angle and/or of the vehicle speed. Electric energy is supplied to the expansion element when the desired temperature taken from the characteristic diagram is below the momentary actual temperature of the coolant. Therefore, it is possible to optimize the coolant temperature at any operating point or operating condition of the internal-combustion engine.

In certain embodiments, the control unit heats the expansion element only after a predetermined operating quantity or environmental quantity hysteresis and/or after a predetermined delay time when a condition is met.

For example, in the case of a desired temperature below the actual temperature, the expansion element is heated only after a predetermined temperature hysteresis and/or a predetermined delay time.

Likewise, in certain embodiments, the control unit blocks the heating of the expansion element only after a predetermined operating quantity or environmental quantity hysteresis and/or after a predetermined delay time, when a condition is met which blocks the heating of the expansion element. For example, in the case of a desired temperature above the actual temperature, the supply of electric energy to the expansion element is blocked only after a predetermined temperature hysteresis and/or after a predetermined delay time.

By means of these embodiments of the invention, in the case of only short-term changes of the operating and/or environmental quantities, the number of control operations is reduced. This means that if a transition is to take place from the activation of the heating to a blocking of the heating and vice versa, this transition will be delayed until a longer-term change is determined.

In certain embodiments, the respectively determined desired temperature is determined essentially by a maximal temperature of the coolant which is permissible as a function of the operating and/or environmental quantities. The object of this development is to optimize the fuel consumption and the exhaust gas emissions. A highest possible operating temperature of the internal-combustion engine is adjusted which, however, as a function of the momentary load of the internal-combustion engine is determined to be only so high that damage to the internal-combustion engine or a power loss because of overheating is avoided.

In certain embodiments of the invention, an activation of the supply of the electric energy or of the heating does not necessarily result in an actual switching-on of the energy supply. An activation may also only be a switch-on option which is based on a certain condition. An actual switching-on may depend, for example, on a logic linking of several switch-on options caused by different operating and environmental quantities. Likewise, the term "blocking" may also be understood as a blocking option relative to an individual condition or as an actual switching-off.

Other objects, advantages and novel features of the present invention will become apparent from the following detailed description of the invention when considered in conjunction with the accompanying drawings.

DETAILED DESCRIPTION OF THE DRAWINGS

Figure 1:
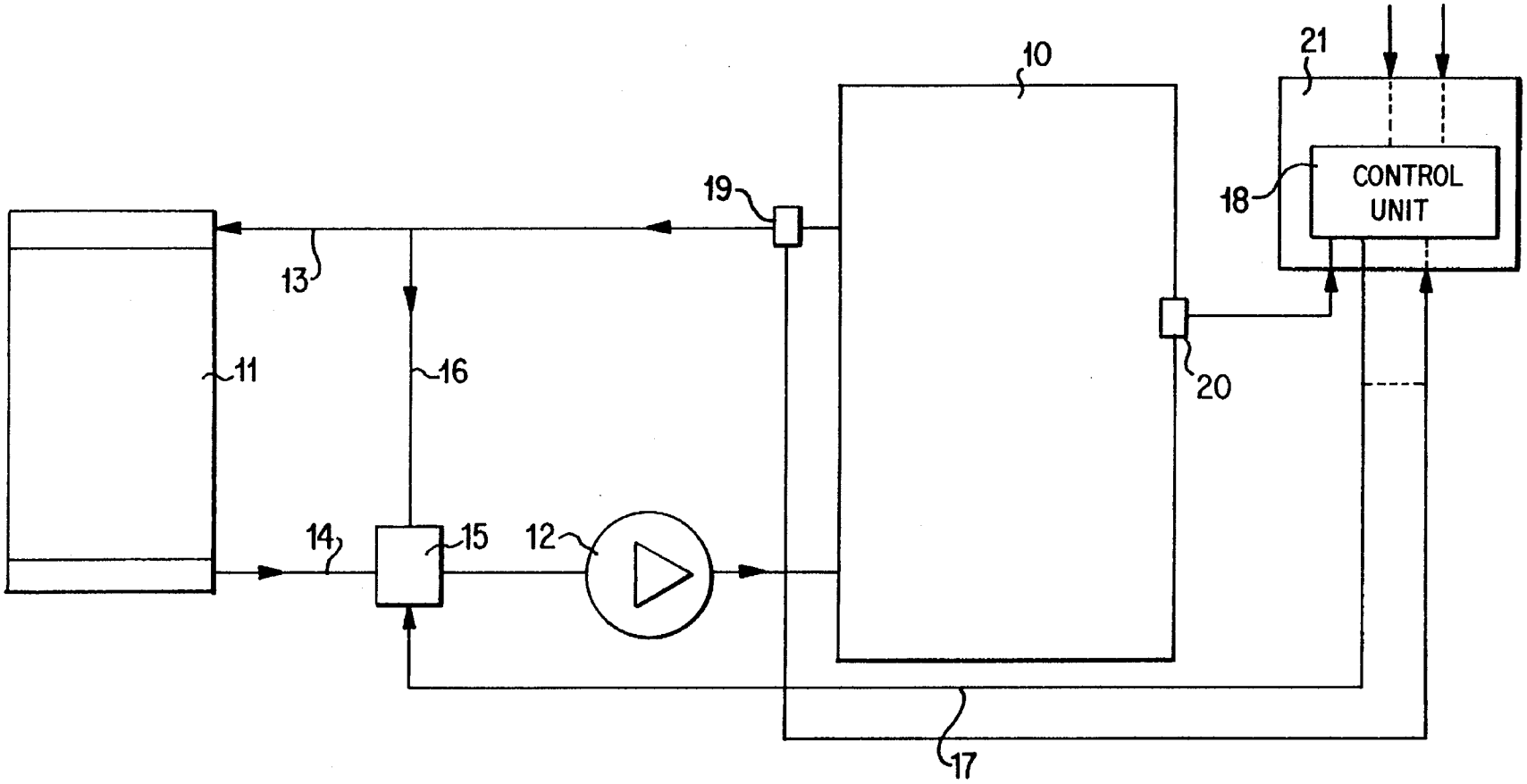
FIG. 1 is a schematic representation of a cooling system constructed according to an embodiment of the present invention.

The cooling system for an internal-combustion engine 10 illustrated in FIG. 1 comprises a radiator 11. Between the internal-combustion engine 10 and the radiator 11, a coolant pump 12 is mounted which generates a flow of the coolant in the direction indicated by arrows. A forward flow pipe 13 leads from the coolant outlet of the internal-combustion engine 10 to the coolant inlet of the radiator 11. A return flow pipe 14 leads from the coolant outlet of the radiator 11 to the coolant inlet of the internal-combustion engine 10. A thermostatic valve 15 comprising an expansion element which is not shown in detail here is arranged in the return-flow pipe 14. A short-circuit pipe 16 to the thermostatic valve 15 branches off the forward flow pipe 13.

The cooling system works essentially in three operating modes. In a first operating mode, the so-called warm-up operation, particularly after the cold start of the internal-combustion engine 10, the thermostatic valve 15 is adjusted such that the coolant flow coming from the internal-combustion engine 10 is essentially completely returned to the internal-combustion engine 10 via the short-circuit pipe 16. In a second operating mode, the cooling system works in the mixed operation; i.e., the coolant coming from the internal-combustion engine 10 flows partially through the radiator 11 and partially by way of the short-circuit pipe 16 back to the internal-combustion engine 10. In a third operating mode, the cooling system works in the radiator operation; i.e., the coolant coming from the internal-combustion engine 10 is returned essentially completely through the radiator 11 to the internal-combustion engine 10.

The operating mode of the cooling system can be adjusted in the direction of the radiator operation or be switched over completely to the radiator operation by heating the expansion element of the thermostatic valve 15 by means of an electric line 17. This reduces the temperature level of the coolant with respect to the temperature level reached by means of an operating mode without heating the expansion element. If, subsequently, the heating by way of the electric line 17 is interrupted, the now cooler coolant will cool the expansion element of the thermostatic valve 15 until it takes up a set end position in the mixed operation so that the coolant temperature is again raised to an end temperature. According to the invention, the set end temperature in the mixed operation is fixed to the upper working limit temperature.

Electric energy is supplied to the thermostatic valve 15 via line 17 by control unit 18 which receives and analyzes several signals from operating and/or environmental quantities. At the coolant outlet of the internal-combustion engine 10, a temperature sensor 19 is arranged which senses the actual temperature of the coolant and transmits it to the control unit 18. In a collector of the intake pipe of the internal-combustion engine 10, another temperature sensor 20 is arranged which senses the temperature of the intake air (fresh air) and transmits it to the control unit 18. Preferably, the control unit 18 is integrated in a known electronic engine control system 21, such as an electronic engine control system sold under the "Motronic" trademark by the firm Robert Bosch GmbH.

The engine control system 21 supplies signals for the sensing of operating and environmental quantities, such as the vehicle speed, the ambient temperature, the rotational speed of the internal-combustion engine and/or the throttle valve opening angle. In addition, the engine control system 21 determines the load condition of the internal-combustion engine 10 from the sensed signals. The load condition is determined, for example, directly or indirectly from the position of the throttle valve, from the rotational speed and/or the air mass in the intake pipe. As a function of the signals received from the control unit 18, for example, a desired temperature of the coolant is determined. If this desired temperature is higher than the actual temperature of the coolant, the expansion element of the thermostatic valve 15 will be heated via line 17.

Figure 2:
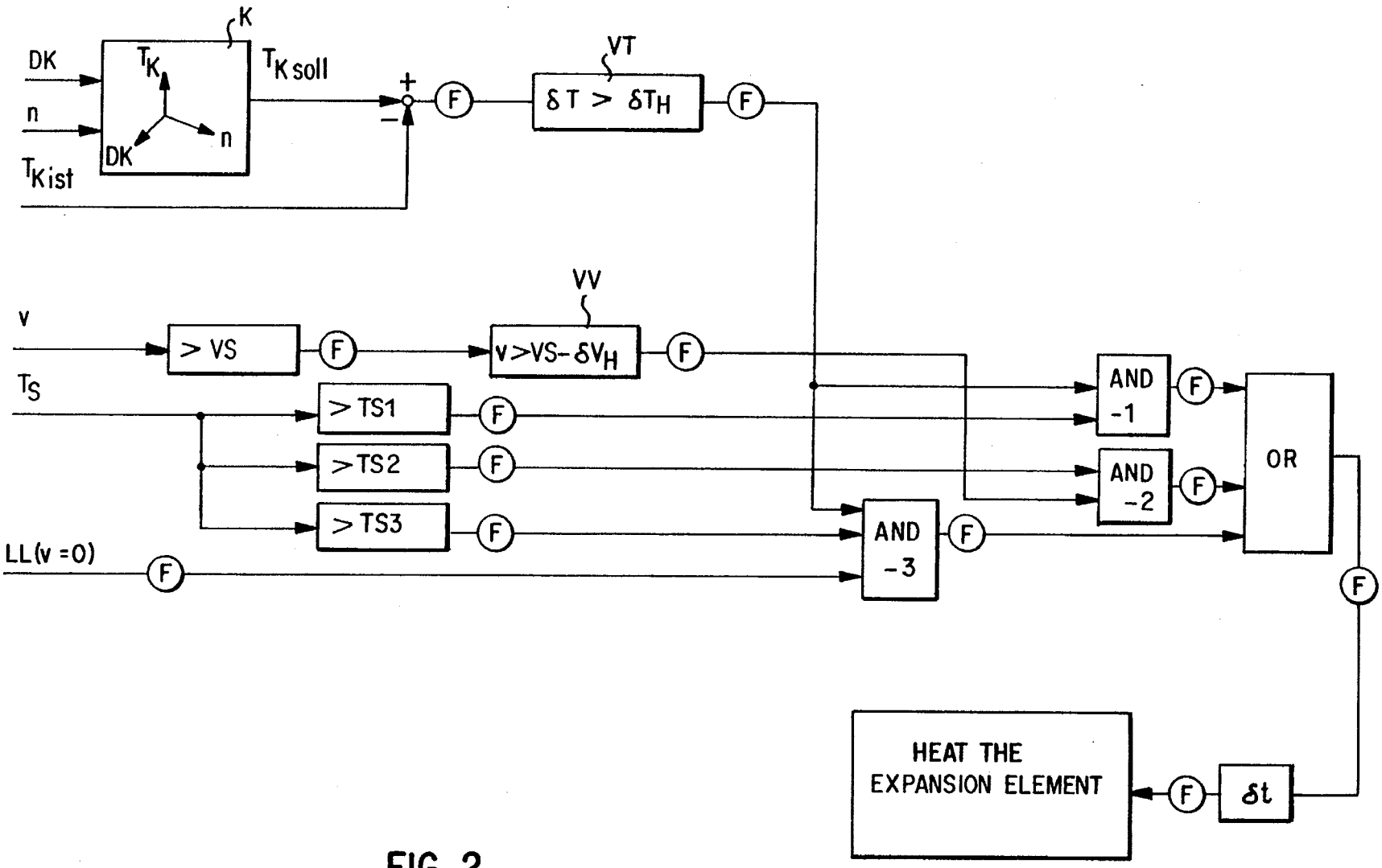
FIG. 2 is a logic diagram of a control of the cooling system according to an embodiment of the present invention.

FIG. 2 illustrates a possible coolant temperature control, in which the actual switching-on of the heating of the expansion element ("heat the expansion element") is controlled by a particularly advantageous logic linking of several individual conditions relative to different operating and environmental quantities of the motor vehicle. This type of a control logic is stored, for example, in the control unit 18, in which case the control unit 18 is integrated, for example, into an already existing control unit or may be a separate integrated component in the thermostatic valve itself.

In FIG. 2, particularly the operating and environmental quantities of throttle valve opening angle DK, rotational engine speed n, actual temperature of coolant $T_{Kist}$, vehicle speed v and intake air temperature $T_S$ which are present, for example, in the form of sensor signals, are processed for controlling the coolant temperature. Beyond the pure sensor signals of the operating and environmental quantities of the motor vehicle, condition signals which were formed from a linking of the individual sensor signals or of the operating and environmental quantities may be processed in the control. In this example, such a condition signal is the idling LL signal when the vehicle is stopped, this signal being formed, for example, from the vehicle speed v and the rotational speed n of the engine. However, other condition signals are also possible which are used in a control of the coolant temperature, such as, the above-mentioned load condition of the internal-combustion engine as well as uphill driving or trailer operations and are preferably formed from the operating quantities throttle valve opening angle DK and vehicle speed v.

In FIG. 2, the sensor signals throttle valve opening angle DK and rotational engine speed n are used for determining from a characteristic diagram K the desired temperature $T_{Ksoll}$ of the coolant at the operating points determined by the throttle valve opening angle DK and the rotational engine speed n. The thus determined desired temperature of the coolant $T_{Ksoll}$ is compared with the actual temperature of the coolant $T_{Kist}$. If the actual temperature $T_{Kist}$ is higher than the desired temperature $T_{Ksoll}$ the heating of the expansion element is activated. In this case, an activation corresponds to an activation option F (circled) and not necessarily to an actual heating.

Furthermore, a hysteresis element VT determines whether the difference $\delta T$ between the actual and the desired temperature changes by more than a predetermined difference $\delta T_H$. It is only then that the activation option F is maintained for heating the expansion element. For this purpose, a logical high signal is given at the output of the hysteresis element VT. This output signal of the hysteresis element VT is supplied to the inputs of the AND gates AND-1 and AND-3.

Generally, in this embodiment, a logical high signal corresponds to an activation option F.

Other activation options F for the heating of the expansion element are generated as a function of the intake air temperature $T_S$. The heating of the expansion element as a function of the intake air temperature $T_S$ is to be activated only when at least one of the three thresholds TS1, TS2 and TS3 is exceeded. When the first threshold TS1 is exceeded, a logical high signal is supplied to the AND gate AND-1; when the second threshold TS2 is exceeded, a logical high signal is supplied to the AND gate AND-2; and when the third threshold TS3 is exceeded, a logical high signal is supplied to the AND gate AND-3.

Furthermore, during idling when the vehicle is stopped, the condition signal LL (at v=0) is supplied to the AND gate AND-3 in the form of a logical high signal.

In addition, according to this embodiment, the activation option F of the heating of the expansion element may also depend on the exceeding of a vehicle speed threshold VS of the vehicle speed v, whereupon a logical high signal is emitted by the output of another hysteresis element VV to a second input of the AND gate AND-2. For the blocking (blocking option) of the heating, it is determined in the hysteresis element VV whether the vehicle speed v has fallen below the threshold VS by a differential value $\delta v_H$. It is only then that a logical low signal (blocking option) is emitted again by the output of the hysteresis element VV to the second input of the AND gate AND-2.

The hysteresis elements VT and VV may also be time delay elements or be connected with time delay elements.

The outputs of the AND gates AND-1 to AND-3 are connected with two of three inputs of an OR gate OR. When a logical high signal exists on the output line of at least one AND gate, an activation option F is generated in the form of a logical high signal also on the output of the OR gate.

Furthermore, a time delay element $\delta t$ may also be provided at the output of the OR gate as a result of which an activation option F at the output of the OR gate will only lead to the actual heating of the expansion element when this activation option F is present for a predetermined time $\delta t$. This prevents a constant switching-on and off of the heating in the case of short-term changes.

The vehicle speed threshold VS is preferably a vehicle speed v, at which the internal-combustion engine is subjected to considerable thermal stress. The thresholds TS1 to TS3 of the intake air temperature $T_S$ are adapted, for example, as a function of the country-oriented construction of the vehicle or the type of construction of the internal-combustion engine or of the radiator. Threshold TS3 will, for example, be lower than thresholds TS1 and TS2 because a more intensive cooling is required in connection with the idling of the engine, during which no additional cooling occurs which is caused by the air stream, than at high vehicle speeds, for example. Therefore, for example, threshold TS2, which is designed in connection with the vehicle speed threshold VS, will be higher than thresholds TS1 and TS3 since, when the driving speed is increased, additional cooling will occur which is caused by the air stream. However, generally, the vehicle and intake air temperature thresholds are determined empirically by experiments. In the case of very cold ambient or intake air temperatures (for example, in "northern countries"), it is important to control the radiator operation as a function of the intake or ambient temperature in order to counteract a thermal shock of the internal-combustion engine. In the case of very hot ambient or intake air temperatures (for example, in "tropical countries"), by control of the coolant temperature as a function of the intake or ambient temperature, a starting weakness in the case of a hot idling operation or stop-and-go operation can be avoided.

In addition, in further embodiments of the invention, when only one of the conditions illustrated in FIG. 2 is met which leads to an activation option F, the heating can in fact be switched on. This means that, for example, the points marked in FIG. 2 by a circled F may each separately also be directly connected with the switch-on device to heat the expansion element.

Figure 3:
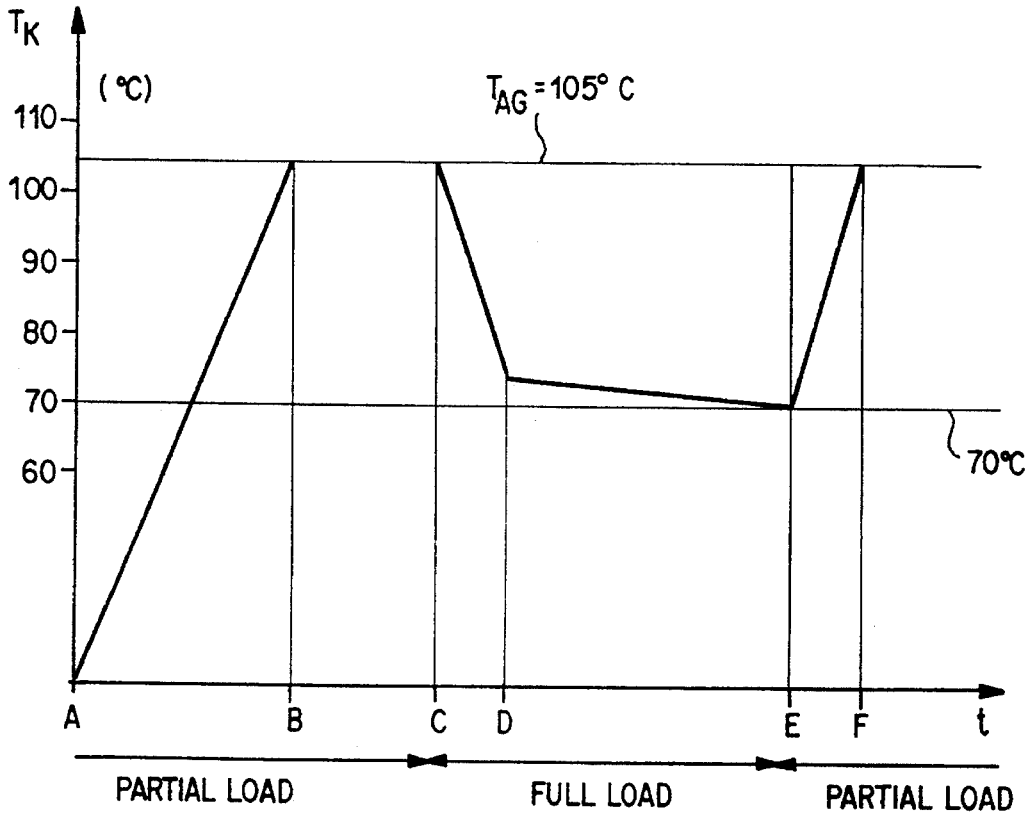
FIG. 3 is a view of a course of the coolant temperature which can be achieved by the cooling system according to the invention.

FIG. 3 shows a diagram of the course of the coolant temperature $T_K$ over time t at partial load and full load, as can be achieved by the cooling system according to the invention. The expansion element of the thermostatic valve 15, for example, is designed by the composition of the expansion material for an upper working limit temperature $T_{AG}$ which, in this case is a coolant temperature of approximately 105° in the set mixed operation. This temperature is illustrated by means of an upper line. A temperature level of 105° C. in the partial load range is expedient in order to reduce, by means of the decrease of friction or the like, the fuel consumption and at the same time improve the exhaust gas composition. Basically, for the optimization of consumption, the coolant temperature should always be as hot as possible, but should be cool in the case of power demands in the full-load range for improving the volumetric efficiency.

In the case of a cold start of the internal-combustion engine, in the range A to B, at first in the warm-up operation and then in the mixed operation during a partial-load operation, the coolant temperature $T_K$ is brought to the temperature level of 105° C. with a higher temperature gradient dT/dt than is possible in the case of the other cooling systems. In this case, the expansion element of the thermostatic valve 15 is heated exclusively by the coolant temperature $T_K$.

The expansion element is designed such that at 105° C. in this case the possible adjusting path of the valve or the maximally possible opening cross-section is not yet adjusted. Thus, in the case of full-load in the range of between C and E, the expansion element can be heated, for example, to such an extent that, for a cooling that is as fast as possible, a maximal opening cross-section is adjusted in the direction of the radiator and, as a result, a complete change to the radiator operation takes place. In this example, a temperature level of approximately 70° C. is reached after a brief cooling time. When the operation of the internal-combustion engine 10 at full load at point E returns to partial load, the supply of electric energy to the expansion element is interrupted. The now colder coolant, which flows around the expansion element, cools the expansion material and has the effect that an adjustment of the thermostatic valve by the expansion element occurs again only as a function of the coolant temperature $T_K$. The thermostatic valve will then again set the coolant temperature $T_K$ and thus the temperature of the internal-combustion engine 10 to the temperature level of 105° C.

The lowering of the coolant temperature $T_K$ in the full-load operation to, for example, a temperature level of approximately 70° C. has the advantage that the internal-combustion engine 10 can then generate the full power. As a result, it is avoided that, because of an excessive temperature, a lower volumetric efficiency is obtained during the combustion which results in a reduction of the power. The lowering of the coolant temperature $T_K$ by heating the expansion element is, however, also controlled as a function of various other operating and/or environmental quantities of the motor vehicle according to certain embodiments of the invention.

Full load can be recognized, for example, by quantities, such as the driving speed, the rotational engine speed or the throttle valve angle. It is, for example, also useful to lower the coolant temperature $T_K$ by heating the expansion element at very low vehicle speeds or during idling and stoppage of the vehicle as well as at high outside temperatures, when driving uphill or in the trailer operation.

Figure 4:
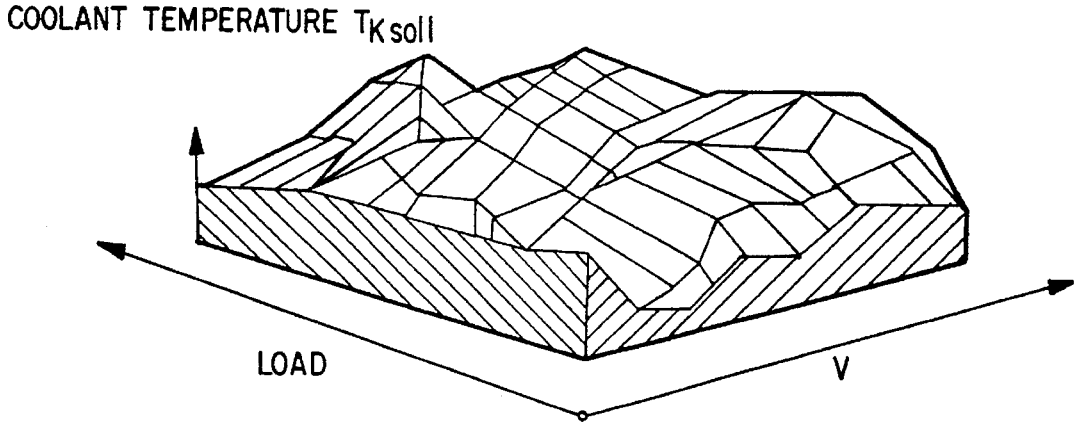
FIG. 4 is a representation of a characteristic diagram of the desired coolant temperature.

FIG. 4 shows a characteristic diagram for the determination of individual desired temperatures $T_{Ksoll}$ of the coolant at individual operating points as a function of the vehicle speed V and the load condition LOAD. In this case, the load condition LOAD, for example, may in turn be determined as a function of the throttle valve angle and of the rotational speed or the air mass in the intake pipe.

The desired temperature of the coolant which is in each case assigned to one operating point determined by two operating quantities respectively can be calculated or determined empirically by experiments. It is also possible to determine a desired temperature of the coolant as a function of several characteristic diagrams which process various operating and/or environmental quantities of the vehicle.

In particular, in certain embodiments according to the invention a cooling system is obtained for various country-oriented variants by adaptation of a characteristic diagram and by the adaptation of the threshold values without changing the hardware or the software of the cooling system.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A cooling system for an internal-combustion engine of a motor vehicle comprising:

a radiator;

a coolant passage communicating the engine with the radiator;

a thermostatic valve arranged in the coolant passage and containing an electrically heatable expansion element; and a control unit coupled to the thermostatic valve which, as a function of at least one of sensed operating data and sensed environmental data of the internal-combustion engine, activates heating of the expansion element;

wherein the thermostatic valve controls the flow of coolant in the cooling system such that in a warm-up operation the expansion element essentially closes to direct coolant from the engine essentially through a short circuit which bypasses the radiator back to the engine, in a partial engine load operation the expansion element partially opens to direct coolant from the engine partially through the short circuit and partially through the radiator back to the engine, the expansion element maintaining an upper working limit coolant temperature without the heating of the expansion element, and in a high engine load operation the control unit activates the heating of the expansion element to further open the expansion element to direct coolant from the engine essentially through the radiator back to the engine to reduce the coolant temperature below the upper working limit coolant temperature.

2. A cooling system according to claim 1, wherein the control unit includes means for sensing the actual temperature of the coolant, for comparing said actual temperature with a predetermined desired temperature and, when said actual temperature is above the desired temperature, activating the heating of the expansion element.

3. A cooling system according to claim 2, wherein the desired temperature of the coolant is a function of at least one of the sensed operating data and the sensed environmental data in tabular form of a look up table.

4. A cooling system according to claim 2, wherein the control unit includes means for continuously determining an actual maximal temperature of the coolant which is permissible as a function of at least one of the sensed operating data and the sensed environmental data by which maximal temperature the desired temperature of the coolant is essentially determined.

5. A cooling system according to claim 1, wherein the control unit includes means for sensing vehicle speed and, as a function of the vehicle speed, activating the heating of the expansion element.

6. A cooling system according to claim 1, wherein the control unit includes means for sensing at least one of a rotational speed of the internal-combustion engine and a throttle valve opening angle and activating the heating of the expansion element as a function of the rotational speed and the throttle valve opening angle.

7. A cooling system according to claim 1, wherein the control unit includes means for sensing at least one of an actual temperature of the intake air and an actual temperature of ambient air, comparing said actual temperature with a predetermined threshold value, and activating the heating of the expansion element when said threshold value is exceeded.

8. A cooling system according to claim 1, wherein the activation of the heating of the expansion element is conditioned upon at least one of a hysteresis difference in at least one of the sensed operating data and the sensed environmental data, and a predetermined time delay.

9. A cooling system according to claim 1, wherein a deactivation of the heating of the expansion element is conditioned upon at least one of a hysteresis difference in at least one of the sensed operating data and the sensed environmental data, and a predetermined time delay.

10. A cooling system for an internal-combustion engine of a motor vehicle comprising:

a radiator;

a coolant passage communicating the engine with the radiator;

a thermostatic valve arranged in the coolant passage and containing an electrically heatable expansion element; and a control unit coupled to the thermostatic valve which, as a function of at least one of sensed operating data and sensed environmental data of the internal-combustion engine, activates heating of the expansion element;

wherein the thermostatic valve controls the flow of coolant in the cooling system such that in a warm-up operation the expansion element essentially closes to direct coolant from the engine essentially through a short circuit which bypasses the radiator back to the engine, in a partial engine load operation the expansion element partially opens to direct coolant from the engine partially through the short circuit and partially through the radiator back to the engine, the expansion element essentially maintaining an upper working limit coolant temperature without the heating of the expansion element, and in a high engine load operation the control unit activates the heating of the expansion element to further open the expansion element to direct coolant from the engine essentially through the radiator back to the engine to reduce the coolant temperature substantially below the upper working limit coolant temperature.

* * * * *